US006469626B1

(12) United States Patent
Hung

(10) Patent No.: US 6,469,626 B1
(45) Date of Patent: Oct. 22, 2002

(54) SECURITY SYSTEM USED IN AN ELECTRONIC INSTRUMENT TO DETECT ILLEGAL OPENING OF THE CASING OF THE ELECTRONIC INSTRUMENT

(75) Inventor: Wen-Chi Hung, Taipei (TW)

(73) Assignee: First International Computer Inc., Taipei (TW)

( * ) Notice: Subject to any disclaimer, the term of this patent is extended or adjusted under 35 U.S.C. 154(b) by 0 days.

(21) Appl. No.: 09/260,562

(22) Filed: Mar. 2, 1999

(51) Int. Cl.[7] ..... G08B 13/12; G08B 13/14

(52) U.S. Cl. ..... 340/568.2; 340/568.1; 340/571

(58) Field of Search ..... 340/568.2, 568.1, 340/568.8, 686.1, 571, 665, 668, 693.9

(56) References Cited

U.S. PATENT DOCUMENTS 4,137,521 A * 1/1979 Martinez ..... 340/568
4,149,158 A * 4/1979 Iwaoka et al. ..... 340/568
4,150,371 A * 4/1979 Scaglione ..... 340/568
4,418,336 A * 11/1983 Taylor ..... 340/571
5,317,304 A * 5/1994 Choi ..... 340/571
5,838,225 A * 11/1998 Todd ..... 340/571
5,933,083 A * 8/1999 Sobczynski et al. ..... 340/568.1

* cited by examiner

*Primary Examiner*—John Tweel
(74) *Attorney, Agent, or Firm*—Rosenberg, Klein & Lee

(57) ABSTRACT

A security system installed in the casing of a computer to detect the condition of the casing of the computer, the security system including a switch which is switched on when the casing of the computer is opened, or switched off when the casing of the computer is closed, and a logic circuit connected to the switch and triggered by the switch to output an alarm signal to a burglar alarm when the casing of the computer is opened.

4 Claims, 5 Drawing Sheets

SECURITY SYSTEM USED IN AN ELECTRONIC INSTRUMENT TO DETECT ILLEGAL OPENING OF THE CASING OF THE ELECTRONIC INSTRUMENT

BACKGROUND OF THE INVENTION

The present invention relates to a security system for an electronic instrument for example a computer, and more particularly to such a security system which is automatically switched on to start a burglar alarm when the casing of the electronic instrument is opened by an intruder.

In order to prohibit other people from stealing storage data from one's personal computer, the boosting program of the computer may be encrypted. However, the encrypted boosting program may easily be decrypted by a computer expert. In order to eliminate this problem, a cover shell may be provided and covered on the control panel of the computer to prevent others from operating the computer.

SUMMARY OF THE INVENTION

It is one object of the present invention to provide a security system for a computer which automatically detects opening/closing status of the casing of the computer. It is another object of the present invention to provide a security system for a computer which can be used in any of a variety of existing computers. It is still another object of the present invention to provide a security system for a computer which automatically triggers burglar alarm when the casing of the computer is opened illegally. To achieve these and other objects of the present invention, there is provided a security system, which comprises a logic circuit controlled to output an alarm signal to audio alarm means, a locating member, for example, a nut provided at a computer's shell, a press means, for example, a screw threaded into the nut, a switch installed in the nut and forced by the screw to switch off the logic circuit, the switch comprising an electrical connector connected to the logic circuit, a rod member installed in the nut and forced by the screw to switch off the electrical connector, and a spring member which pushes the rod member outwards when the screw is disconnected from the nut, causing the electrical connector to be switched on by the rod member.

DETAILED DESCRIPTION OF THE PREFERRED EMBODIMENT

Figure 1:
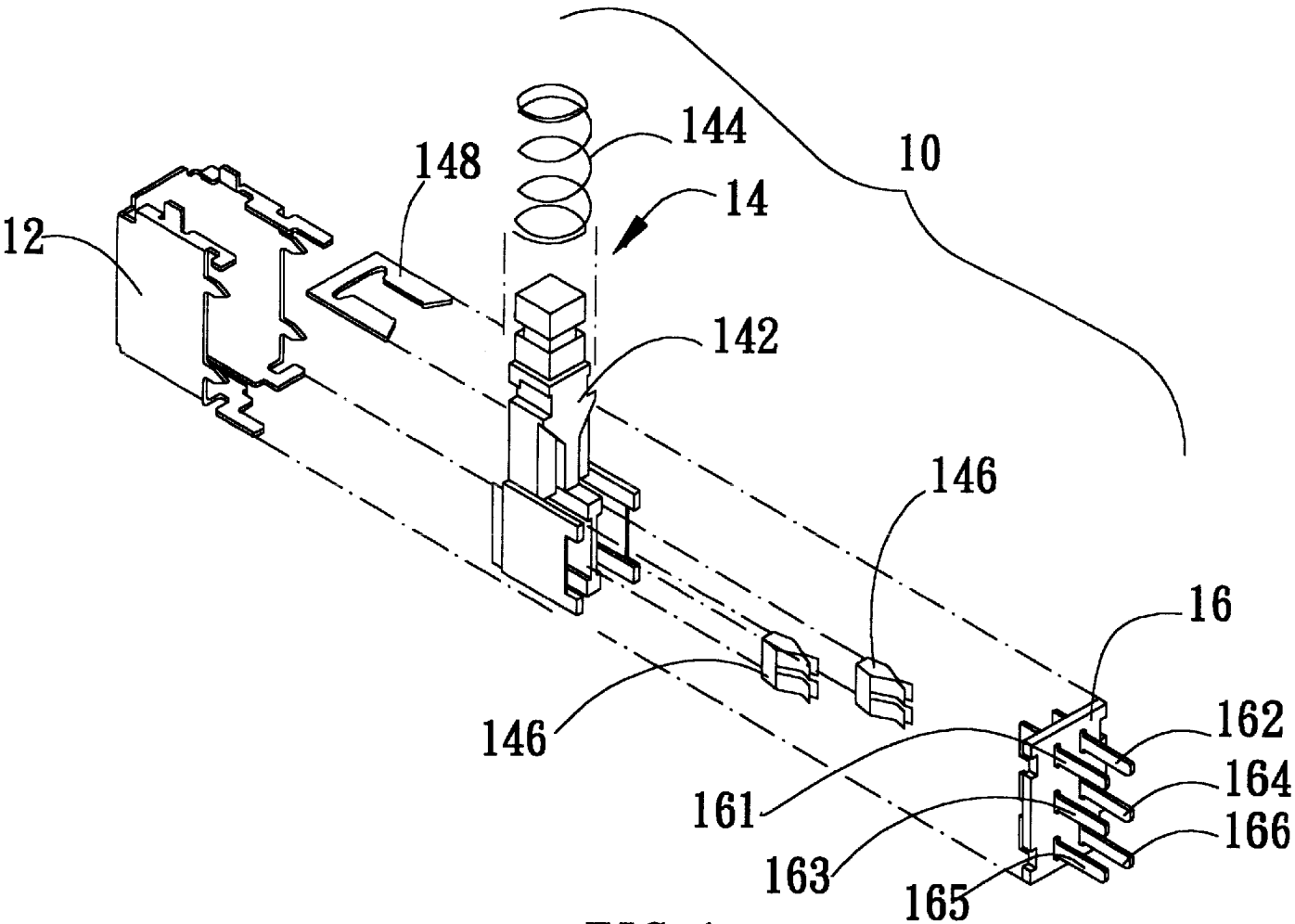
FIG. 1 is an exploded view of a switch for a security system according to the present invention.

Referring to FIG. 1, a switch 10 is shown comprised of a shell 12, which is a part of an electronic instrument for example a computer, a spring assembly 14, and an electrical connector 16. The spring assembly 14 comprises a rod member 142 coupled to the shell 12, a stop plate 148 fastened to the periphery of the rod member 142 outside the shell 12, a spring 144 mounted around the rod member 142 and stopped between the stop plate 148 and the shell 12 to push rod member 142 outwards from the shell 12, and two metal clamping plates 146 fastened to one end namely the bottom end of the rod member 142 at two opposite sides. The electrical connector 16 comprises six metal contacts, namely, the first metal contact 161, the second metal contact 162, the third metal contact 163, the fourth metal contact 164, the fifth metal contact 165, and the sixth metal contact 166 arranged in two rows. The first metal contact 161 and the second metal contact 162 are horizontally aligned at the top. The fifth metal contact 165 and the sixth metal contact 166 are horizontally aligned at the bottom. The third metal contact 163 and the fourth metal contact 164 are horizontally aligned in the middle.

Figure 2A:
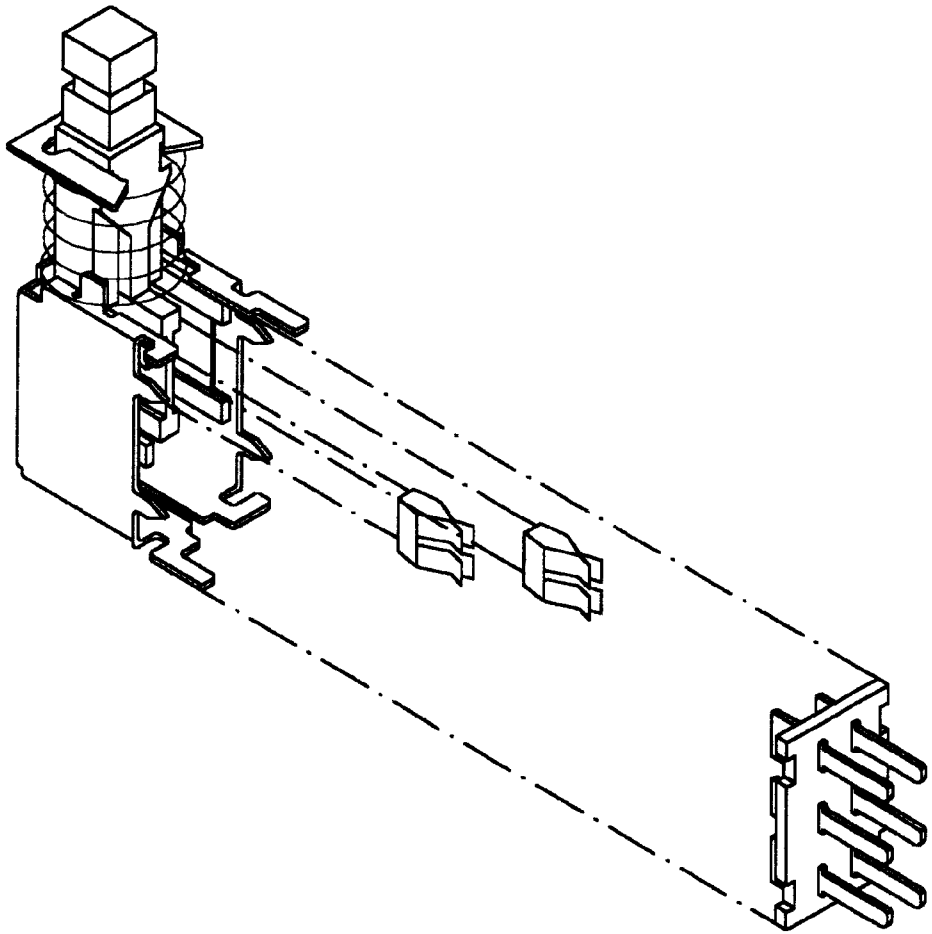
FIG. 2A is an assembled view of the switch shown in FIG. 1.
Figure 2B:
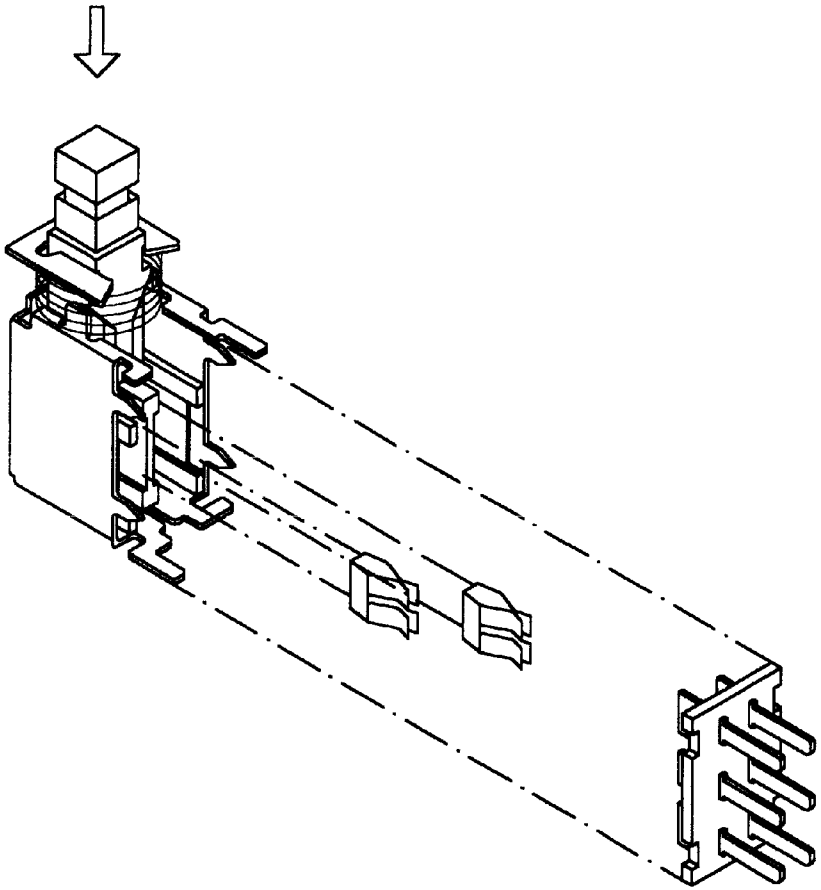
FIG. 2B is similar to FIG. 2A but showing the rod member depressed.

Referring to FIGS. 2A and 2B, the spring 144 imparts an upward pressure to the stop plate 148, causing the top end of the rod member 142 to be extended out of the shell 12 and the flanged bottom end of the rod member 142 to be stopped below the flanged top side of the shell 12 (see FIG. 2A). At this stage, the metal clamping plates 146 are disposed in contact with the upper four metal contacts 161, 162, 163, and 164 at the electrical connector 16, causing the switch 10 to be switched on. On the contrary, when the rod member 142 is pressed down (see FIG. 2B), the metal contacts 161, 162, 163, and 164 are lowered with the rod member 142 and moved into contact with the lower four metal contacts 163, 164, 165, and 166 at the electrical connector 16, causing the switch 10 to be switched off.

Figure 3:
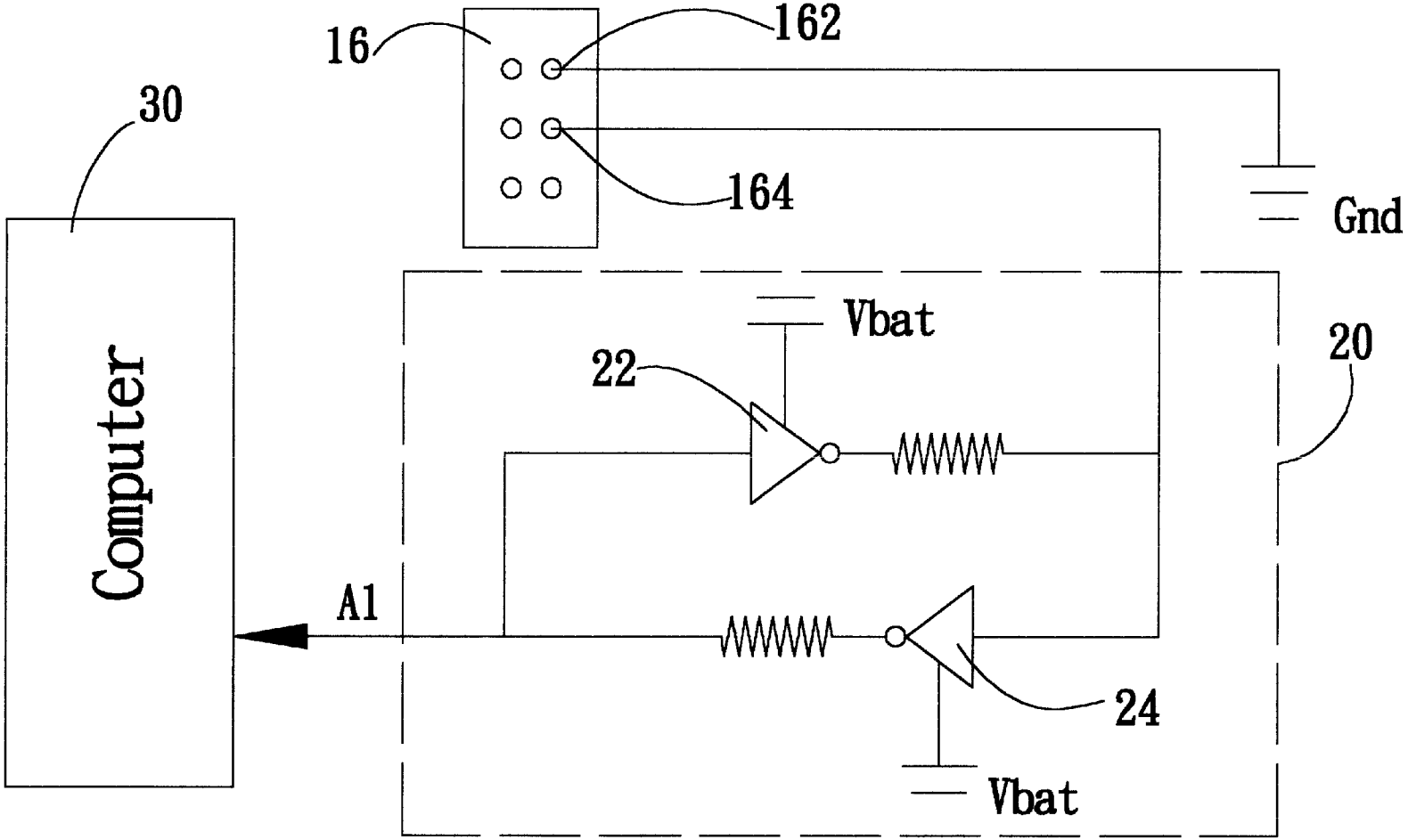
FIG. 3 is a circuit diagram of the security system according to the present invention.

Referring to FIG. 3 and FIGS. 1 and 2 again, the electrical connector 16 is connected to a logic circuit 20 in a computer 30. One of the top metal contacts, for example, the second metal contact 162 is connected to ground. One of the intermediate metal contacts, for example the fourth metal contact 164 is connected to the logic circuit 20. The logic circuit 20 is comprised of two flip-flops 22 and 24 reversely connected to the computer 30. When the rod member 142 is depressed, the third, fourth, fifth and sixth metal contacts 163, 164, 165, and 166 are electrically connected, and the logic circuit 20 does no work, therefore the computer 30 works normally. When the pressure is released from the rod member 142, the rod member 142 is pushed upwardly outwards from the shell 12 by the spring 144 to shift the metal clamps 146 into contact with the first, second, third and fourth metal contacts 161, 162, 163, and 164, thereby causing the logic circuit 20 to output an alarm signal A1 to the computer 30. Upon receipt of the alarm signal A1 from the logic circuit 20, the computer 30 immediately starts a burglar alarm and/or an encryption program.

Figure 4:
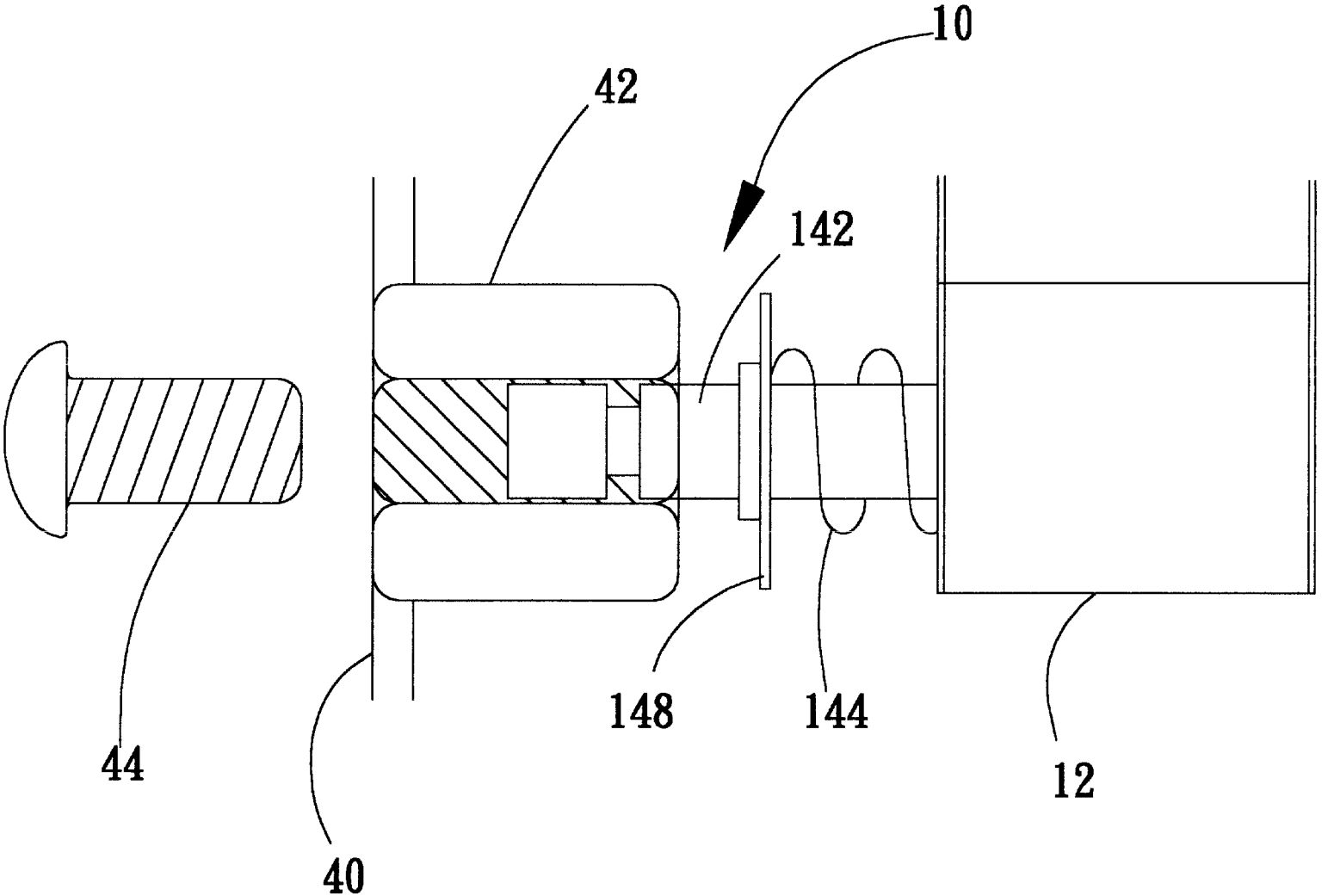
FIG. 4 shows an installation example of the switch of the security system according to the present invention.

FIG. 4 shows an installation example of the present invention. As illustrated, the rod member 142 of the switch 10 has one end inserted into a first shell 12 of the computer, and an opposite end inserted into a nut 42 at a second shell 40 of the computer. When a tie screw 44 is threaded into the nut 42 to secure the second shell 40 in place, the rod member 142 is pressed down, and the logic circuit 20 gives no signal to the computer 30 (see also FIG. 3). When the tie screw 44 is removed from the nut 42, the rod member 142 is released, and the logic circuit 20 is triggered to output an alarm signal A1 to the computer 30, causing the computer 30 to start a burglar alarm and/or an encryption program. When releasing the burglar alarm and/or the encryption program, a particular code must be inputted into the computer.

As indicated above, the present invention provides a security system installed in a computer to detect the condition of the casing of the computer by means of a switch, and to provide an alarm signal to a burglar alarm and/or an encryption program by means of a logic circuit when the casing of the computer is opened.

It is to be understood that the drawings are designed for purposes of illustration only, and are not intended as a definition of the limits and scope of the invention disclosed.

What the invention claimed is:

1. A security system comprising:

a logic circuit controlled to output an alarm signal to audio alarm means;

a locating member provided at a shell of an electronic instrument;

a press means installed in said locating member;

a switch installed in said locating member and forced by said press means to switch off said logic circuit, said switch comprising an electrical connector connected to said logic circuit, a rod member having a top end inserted into said locating member and being forced by said press means to switch off said electrical connector, a stop plate affixed to a periphery of said rod member, and a spring member mounted around said rod member and having a first end abutting said stop plate to apply a bias force to said rod member, said rod member having two metal clamps at a bottom end thereof moved with said rod member on said electrical connector, said electrical connector being switched on by said rod member responsive to said press means being removed.

2. The security system of claim 1 wherein said locating member is a nut, and said press means is a screw threaded into said nut.

3. The security system of claim 1 wherein said switch further comprises a hollow shell fixedly mounted inside a casing of the electronic instrument, said hollow shell being disposed around said bottom end of said rod member and abutting a second end of said spring member.

4. The security system of claim 3 wherein said electrical connector is coupled to said shell at one side relative to said rod member, said electrical connector having a plurality of electrical contacts for contact by said metal clamps at said rod member to apply on and off switching signals to said logic circuit.

* * * * *